US006718696B2

(12) United States Patent
Silberman et al.

(10) Patent No.: US 6,718,696 B2
(45) Date of Patent: Apr. 13, 2004

(54) MOVABLE WALL FOR STADIUM

(75) Inventors: Cyril Silberman, Minnetonka, MN (US); David Sadinsky, Minneapolis, MN (US); Bart Riberich, Brooklyn Park, MN (US); Andrew Cheng, New Brighton, MN (US); Lennart Nielson, Edina, MN (US); Terry Thompson, Minneapolis, MN (US); Timothy J. Kline, Minnetonka, MN (US)

(73) Assignee: Uni-Systems, LLC, Minneapolis, MN (US)

( * ) Notice: Subject to any disclaimer, the term of this patent is extended or adjusted under 35 U.S.C. 154(b) by 0 days.

(21) Appl. No.: 10/053,755

(22) Filed: Jan. 22, 2002

(65) Prior Publication Data

US 2002/0134028 A1 Sep. 26, 2002

Related U.S. Application Data

(60) Provisional application No. 60/263,645, filed on Jan. 23, 2001.

(51) Int. Cl.[7] ..... E04H 3/10; E04B 1/346; A63J 1/02; A63C 19/00

(52) U.S. Cl. ..... 52/6; 52/64; 472/92; 472/77

(58) Field of Search ..... 52/6, 9, 64, 67; 472/77, 92

(56) References Cited

U.S. PATENT DOCUMENTS

| | | | | | |
|---|---|---|---|---|---|
| 721,767 | A | * | 3/1903 | Wood | 52/7 |
| 2,052,217 | A | | 8/1936 | Sibour et al. | |
| 2,116,114 | A | * | 5/1938 | Guidorossi | 472/61 |
| 2,603,171 | A | | 7/1952 | Smith | |
| 2,642,162 | A | | 6/1953 | Tobias | |
| 3,009,211 | A | | 11/1961 | Hansen et al. | |
| 3,213,571 | A | | 10/1965 | Olson | |
| 3,288,158 | A | | 11/1966 | Gugliotta | |
| 3,534,511 | A | | 10/1970 | Cappella | |
| 3,608,252 | A | | 9/1971 | Bisson | |
| 3,766,691 | A | | 10/1973 | Ray | |
| 4,175,361 | A | | 11/1979 | Kumode | |
| 4,257,199 | A | | 3/1981 | Kuboyama | |
| 4,348,833 | A | | 9/1982 | Nagoya | |
| 4,587,775 | A | | 5/1986 | Lewis et al. | |
| 4,616,451 | A | | 10/1986 | Glick | |
| 4,674,241 | A | * | 6/1987 | Sarrazin | 52/67 |
| 4,676,033 | A | | 6/1987 | Allen et al. | |
| 4,682,449 | A | | 7/1987 | Berger | |
| 4,706,419 | A | | 11/1987 | Adachi et al. | |
| 4,716,691 | A | * | 1/1988 | Allen et al. | 52/6 |
| 4,727,688 | A | | 3/1988 | Kida et al. | |
| 4,735,415 | A | * | 4/1988 | Corn | 273/317.7 |

(List continued on next page.)

*Primary Examiner*—Brian E. Glessner
*Assistant Examiner*—Kevin McDermott
(74) *Attorney, Agent, or Firm*—Knoble Yoshida & Dunleavy, LLC

(57) ABSTRACT

A convertible stadium includes an exhibition area, a seating area and an outer sidewall in which is defined in large opening, preferably located so as to provide favorable outdoor views to the occupants of the stadium. A movable wall member is advantageously position so as to be able to open or close the large opening. When the movable wall member is in a first, retracted position spectators will be provided with a view of the outdoors and a great deal of outdoor air and sunlight. When outdoor conditions are unfavorable for an intended event within the stadium, however, the movable wall member may be repositioned in order to partially or fully close the opening. Such unfavorable conditions may include undesirable sun position, an undesirable amount of wind or humidity; or unfavorable temperatures. The movable wall member may be deployed in combination with a retractable roof in an otherwise indoor stadium, resulting in a convertible stadium that may be converted to have a true outdoor feel during favorable weather conditions.

27 Claims, 8 Drawing Sheets

U.S. PATENT DOCUMENTS 4,738,057 A 4/1988 Logan
4,751,800 A 6/1988 Kida et al.
4,785,590 A * 11/1988 Jones ..... 52/64
4,802,314 A 2/1989 Schildge, Jr.
4,831,792 A 5/1989 Berger
4,833,837 A 5/1989 Bonneau
4,920,707 A 5/1990 Moskaliuk et al.
4,936,060 A 6/1990 Gelinas et al.
4,942,698 A 7/1990 Kumagai
4,995,203 A 2/1991 Brisbin et al.
5,007,214 A 4/1991 Itami et al.
5,010,695 A 4/1991 Schildge, Jr.
5,027,565 A 7/1991 Sugizaki
5,035,093 A * 7/1991 Parazader et al. ..... 52/64
5,058,332 A 10/1991 Masuyama et al.
5,062,243 A 11/1991 Kumagai
5,063,730 A 11/1991 Muramoto et al.
5,103,600 A 4/1992 Geiger et al.
5,117,594 A 6/1992 Muramoto et al.
5,167,097 A * 12/1992 Robbie et al. ..... 52/6
5,187,894 A 2/1993 Ripley, Sr. et al.
5,203,125 A 4/1993 Sugizaki
5,257,481 A * 11/1993 Reppas et al. ..... 52/6
5,257,485 A 11/1993 Kawaguchi et al.
5,371,983 A 12/1994 Kawaguchi et al.
5,394,659 A * 3/1995 Kawaguchi et al. ..... 52/66
5,394,660 A 3/1995 Haris
5,653,066 A 8/1997 Schildge, Jr.
5,682,711 A 11/1997 Warczak
5,740,641 A * 4/1998 Oxnard ..... 52/234
5,746,028 A 5/1998 DiBenedetto
5,778,603 A 7/1998 Reppas
5,850,712 A * 12/1998 Errato ..... 52/8
5,896,708 A 4/1999 Doi et al.
5,927,022 A 7/1999 Hirakawa et al.
5,987,823 A * 11/1999 Zarnick ..... 52/6

* cited by examiner

MOVABLE WALL FOR STADIUM

This application claims priority under 35 USC §119(e) based on U.S. Provisional Application Ser. No. 60/263,645, filed Jan. 23, 2001, the entire disclosure of which is hereby incorporated by reference as if set forth fully herein.

BACKGROUND OF THE INVENTION

1. Field of the Invention

This invention relates generally to the field of large stadiums, such as athletic stadiums, and in particular to stadiums of the type that are designed for indoor operation and are further convertible to permit outdoor air or light into the stadium.

2. Description of the Related Technology

Historically, most large stadiums such as those that are used for major collegiate and professional sports were of the fully outdoor, open bowl design. This changed, however, with the advent of the large, indoor domed professional sports stadiums in the 1970s. An indoor stadium has many economic advantages over traditional outdoor stadiums, particularly in cities that have extreme weather conditions.

Unfortunately, large indoor stadiums have disadvantages as well. One notable disadvantage of indoor stadiums is the lack of sufficient sunlight and precipitation to grow natural grass. In the last few years, convertible stadium designs in which a retractable roof is provided have become very popular. In addition to permitting spectators and athletes to experience some approximation of outdoor conditions when the weather is good, convertible stadiums may be designed to permit sufficient sunlight into the stadium for grass to grow. While retractable roof stadiums provide many of the advantages of both indoor and outdoor designs, exposure of spectators and athletes to sunlight, precipitation and outdoor air is still less than in outdoor stadiums, and many spectators and athletes consequently would prefer to be in outdoor stadium when weather conditions are favorable.

Another disadvantage with traditional large, indoor stadiums is that their indoor construction effectively prevents spectators from viewing the landscape outside the stadium. One popular outdoor stadium design that has been used in baseball stadiums provides an open end through which spectators could see the outdoor landscape and the horizon. Some cities have used such stadium designs to make visible buildings and geographic landmarks that are characteristic to the city or region. Unfortunately, the need for physical containment in an indoor stadium precludes such an open end design. Accordingly, a spectator viewing an event within an indoor stadium in New Orleans might have an experience that is indistinguishable from another spectator viewing a similar event in an indoor stadium in Seattle. Clearly, most cities and professional sports organizations would prefer a stadium venue that is emblematic of the spirit and characteristics of the host city and the surrounding region.

A need exists for a convertible stadium that is capable of being configured so as to provide spectators a more genuine outdoor-like experience when weather conditions are good, and that further may be configured so as to provide spectators with a view of at least a portion of the landscape that is outside of the stadium.

SUMMARY OF THE INVENTION

Accordingly, it is an object of the invention to provide a convertible stadium that is capable of being configured so as to provide spectators a more genuine outdoor-like experience when weather conditions are good, and that further may be configured so as to provide spectators with a view of at least a portion of the landscape that is outside of the stadium.

In order to achieve the above and other objects of the invention, a convertible stadium that is constructed according to a first aspect of the invention includes an exhibition area, a seating area that is constructed and arranged to permit spectators to view events in the exhibition area, a sidewall that at least partially forms an outer periphery of the stadium, the sidewall having an opening defined therein that is at least 100 square meters in area, a movable wall member that is movable between a first position wherein it covers a first portion of the opening and a second position wherein the movable wall member covers less than the first portion of the opening; and a transport mechanism for moving the movable wall member between the first position and the second position.

According to a second aspect of the invention, a method of operating a convertible stadium that includes an exhibition area, a seating area and a sidewall having a large opening to the outdoors defined therein includes steps of positioning a movable wall in a first, closed position so as to cover at least a first portion of the opening; and moving the movable wall to a second, open position wherein the movable wall member covers less than the first portion of said opening, whereby the exhibition and seating areas will be exposed to an outdoor enhanced environment.

According to a third aspect of the invention, a method of operating a convertible stadium that includes an exhibition area, a seating area and a sidewall having a large opening to the outdoors defined therein includes steps of positioning a movable wall in an open position so as to leave a first substantial portion of the opening unobstructed, providing openness between the exhibition area, the seating area and the outdoor environment; and moving the movable wall to a second, closed position wherein less than the first, substantial portion of the opening is left unobstructed, thereby reducing the amount of openness between the exhibition area, the seating area and the outdoor environment.

In a fourth aspect of the invention, a method of constructing a convertible stadium includes steps of identifying an outdoor landscape, constructing a stadium having an interior exhibition area, an interior seating area and an outer sidewall that has a large opening defined therein, the opening having a surface area that is at least 100 square meters, the opening further being aligned with the outdoor landscape so as to provide a view of the outdoor landscape to spectators in at least one portion of the interior seating area; and positioning a movable wall within the opening, the movable wall being shaped and mounted for movement between a first, open position wherein a spectator in said at least one portion of the interior seating area will have an unobstructed view of the outdoor landscape and a second, closed position wherein the spectator will no longer be able to view the outdoor landscape.

According to a fifth aspect of the invention, a convertible stadium includes an exhibition area, a seating area that is constructed and arranged to permit spectators to view events in the exhibition area, a sidewall that at least partially forms an outer periphery of the stadium, said sidewall having an opening defined therein that is at least 100 square meters in area, a movable wall member that includes a plurality of movable wall panels that are mounted for independent movement with respect to the other wall panels and are shaped and sized so as to permit substantial overlap therebetween, whereby the wall panels may be extended and contracted with respect to each other to respectively cover and uncover said opening, transport structure for moving the movable wall panels, and a control system for operating the transport structure.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
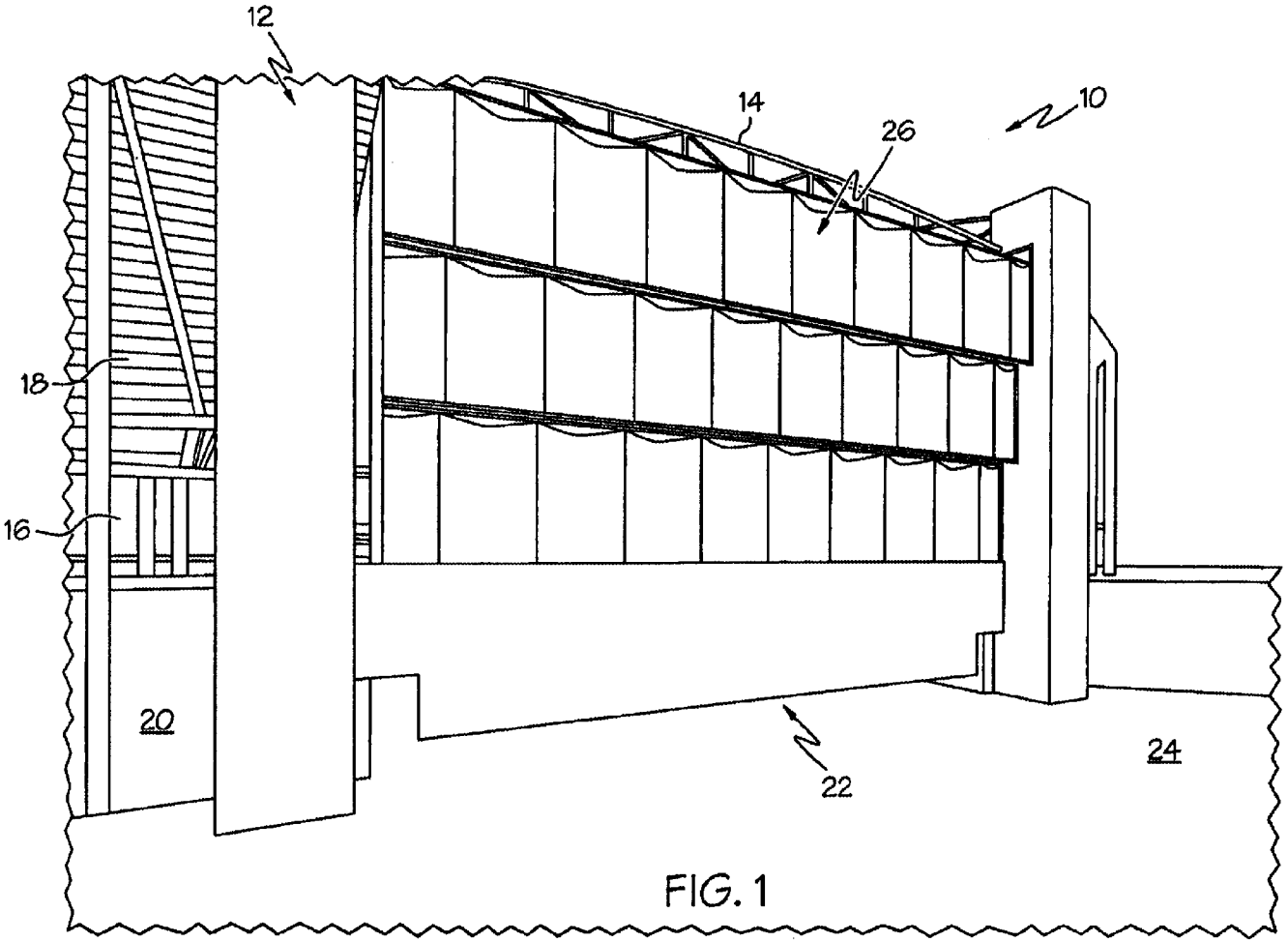
FIG. 1 is a fragmentary perspective view of a convertible stadium complex that is constructed according to a preferred embodiment of the invention.

Referring now to the drawings, wherein like reference numerals designate corresponding structure throughout the views, and referring in particular to FIG. 1, a stadium complex 10 that is constructed according to a preferred embodiment of the invention includes a convertible stadium 12 having a retractable roof 14. Stadium 12 has an indoor area defined therein in which a central exhibition area 16 such as a playing field is located, and further has a seating area 18 position around the central exhibition area 16 so that spectators will have a favorable view of the exhibition area, as is conventional. It is to be understood that stadium 12 is to be constructed as a very large edifice, having a continuous exhibition area 16 that is at least 35,000 square feet in area.

As may be seen in FIG. 1, stadium 12 further includes a peripheral outer sidewall 20, in which is defined a large opening 22. In this context, large is defined as being at least 50 feet in height and 100 feet in width. Preferably, opening 22 has a surface area that is at least 500 square meters, and is more preferably at least 1200 square meters. Opening 22 is also preferably defined in a portion of the peripheral outer sidewall 20 that is selected so that a person who is seated in at least one portion of the seating area 18 will have a view of an outdoor landscape 24 that is outside the stadium 12 when the opening 22 is unobscured. The location of the opening 22 in the outer sidewall 20 of the stadium 12 may be selected so that spectators will have a view of the horizon, of local geographical or manmade landmarks, or so as to optimize exposure of the occupants of the stadium to such environmental factors as direct sun or wind.

According to one particularly important aspect of the invention, a movable wall member may be positioned within the opening 22, as shown in FIG. 1. Movable wall member 26 is movable at least between a first position, shown in FIGS. 1 and 2, in which it covers a first portion of the opening 22 and a second position, shown in FIG. 3, in which it covers less than the first portion of the opening 22. In the preferred embodiment, as shown in FIG. 1, wall member 26 covers substantially the entire surface area of the opening 22 when it is in the first position. When in the second position shown in FIG. 3, wall member 26 preferably covers 35 percent or less of the surface area of the opening 22.

Figure 2:
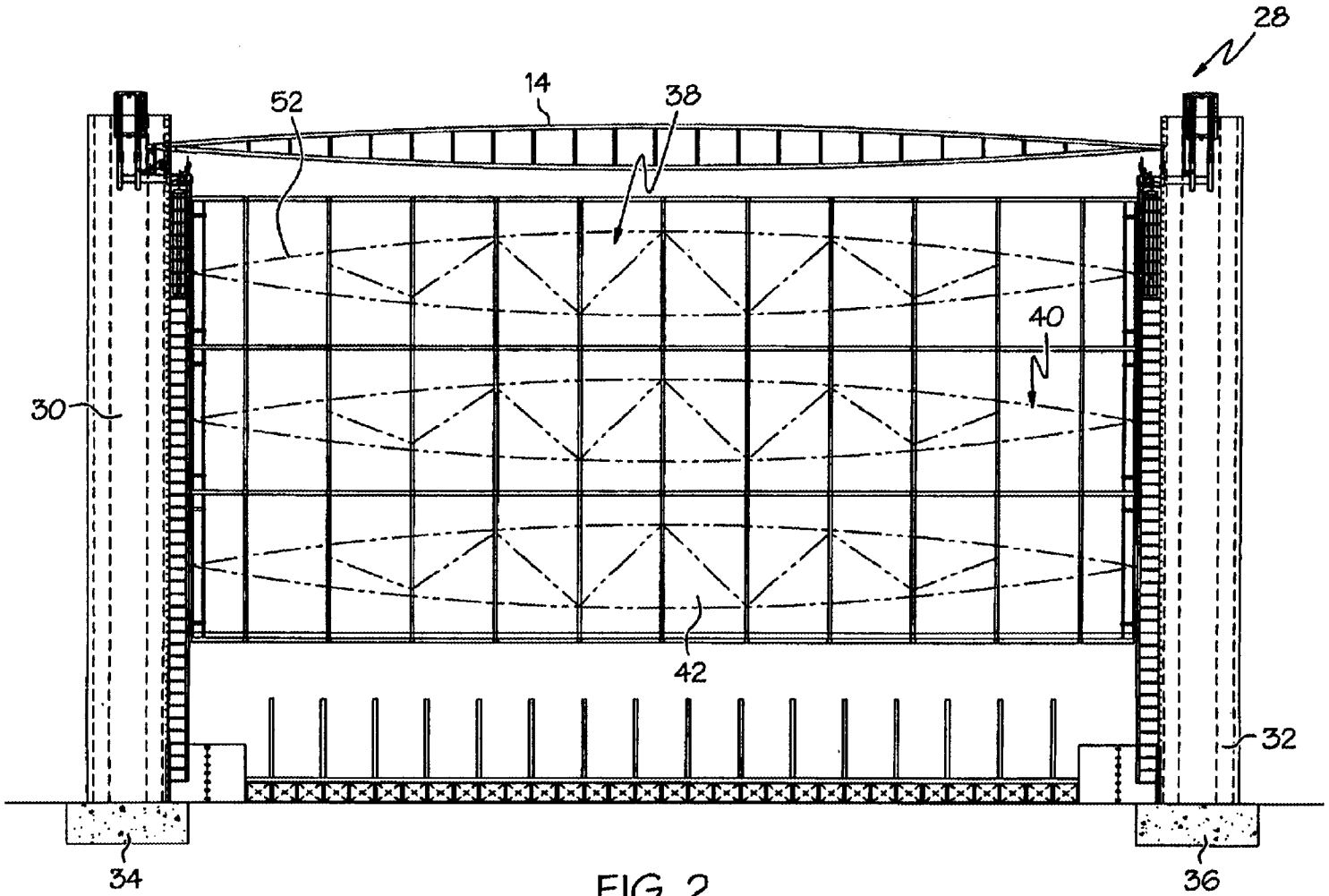
FIG. 2 is a fragmentary side elevational view of a portion of the complex that is depicted in FIG. 1, shown in a first operational position.
Figure 3:
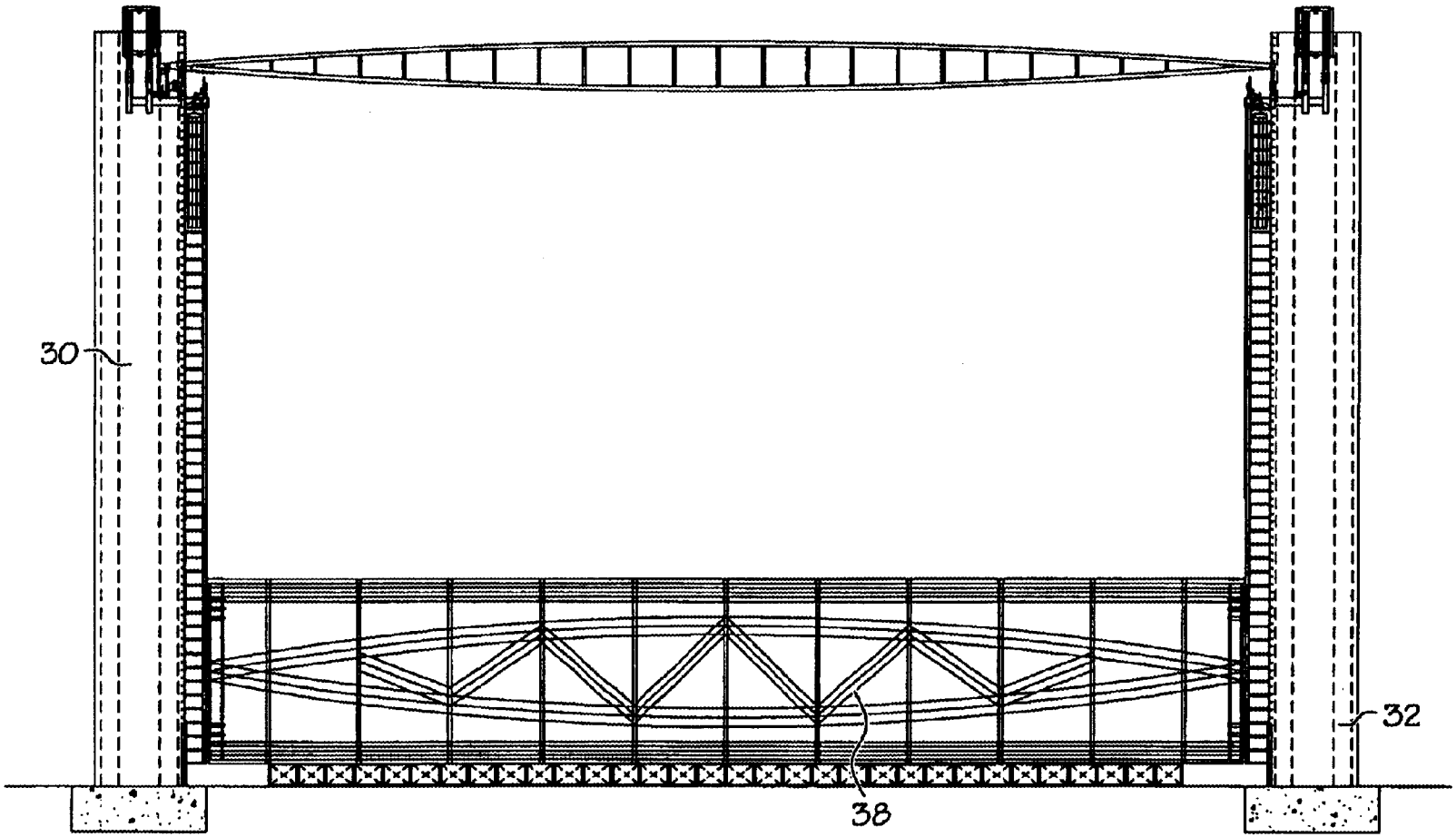
FIG. 3 is a fragmentary side elevational view identical to that shown in FIG. 2, shown in a second operational position.

Referring now to FIG. 2, it will be seen that in the preferred embodiment movable wall member 26 includes a plurality of independently movable wall panels that are movable relative to each other by means of a transport mechanism 28 in order to reposition the movable wall member 26 between the first and second positions. In the illustrated embodiment, movable wall member 26 includes a first, upper movable wall panel 38, a second, intermediate movable mall panel 40 and a third, lower movable wall panel 42. As may be seen in the cross-sectional view that is provided in FIG. 4, each of the movable wall panels 38, 40, 42 includes an internal Z-shaped truss that provides sufficient strength to prevent significant flexure of the respective wall panel as a result of wind forces, which can be significant, and further permits nesting of the panels 38, 40, 42 as the panels are moved into an overlapping position during the opening of the movable wall member 26. As a result of the significant strength and nesting capability imported by the Z-shaped trusses it is possible to construct a large movable wall member 26 that is relatively lightweight and thin. In quantitative terms, the depth or thickness of each wall panel 38, 40, 42 in relation to the span or width of the door panel preferably exhibits a depth to width ratio of at least about 20/1, more preferably at least about 40/1 and most preferably at least about 50/1. In addition, each wall panel 38, 40, 42 preferably exhibits a weight to surface area ratio (with surface area being defined as the surface area in the vertical plane that is occupied by the wall panel) that is less than or equal to about 10 pounds per square foot.

Looking again to FIG. 4, it will be seen that each of the Z-shaped trusses includes an upper horizontal portion 46, a vertical portion 48 and a bottom horizontal portion 50. The horizontal portions 46, 50 provide a measure of resistance against flexure of the respective wall panel during operation. Each of the wall panels 38, 40, 42 further include a plurality of cover modules or facades that provide an aesthetically pleasing surface to be visible portions of the wall panels. In the preferred embodiment, the cover modules 52 are formed a fabric that is anchored to the underlying Z-shaped truss of the respective wall panel. Alternatively, other materials such as brick, glass, or even electronic accessories such as a display screen could be used.

Figure 4:
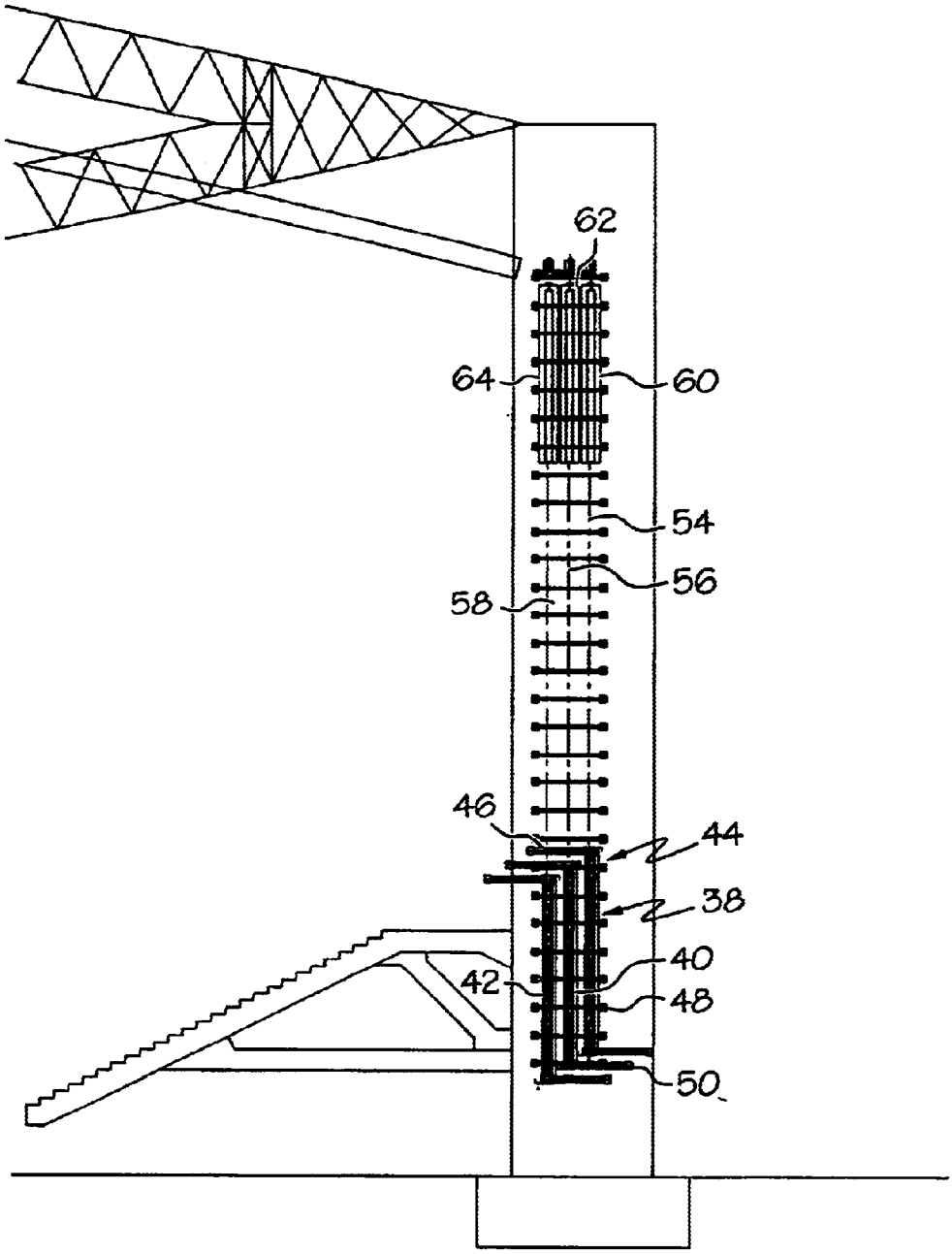
FIG. 4 is a fragmentary cross-sectional view taken through a portion of the structure shown in FIGS. 2 and 3.
Figure 5:
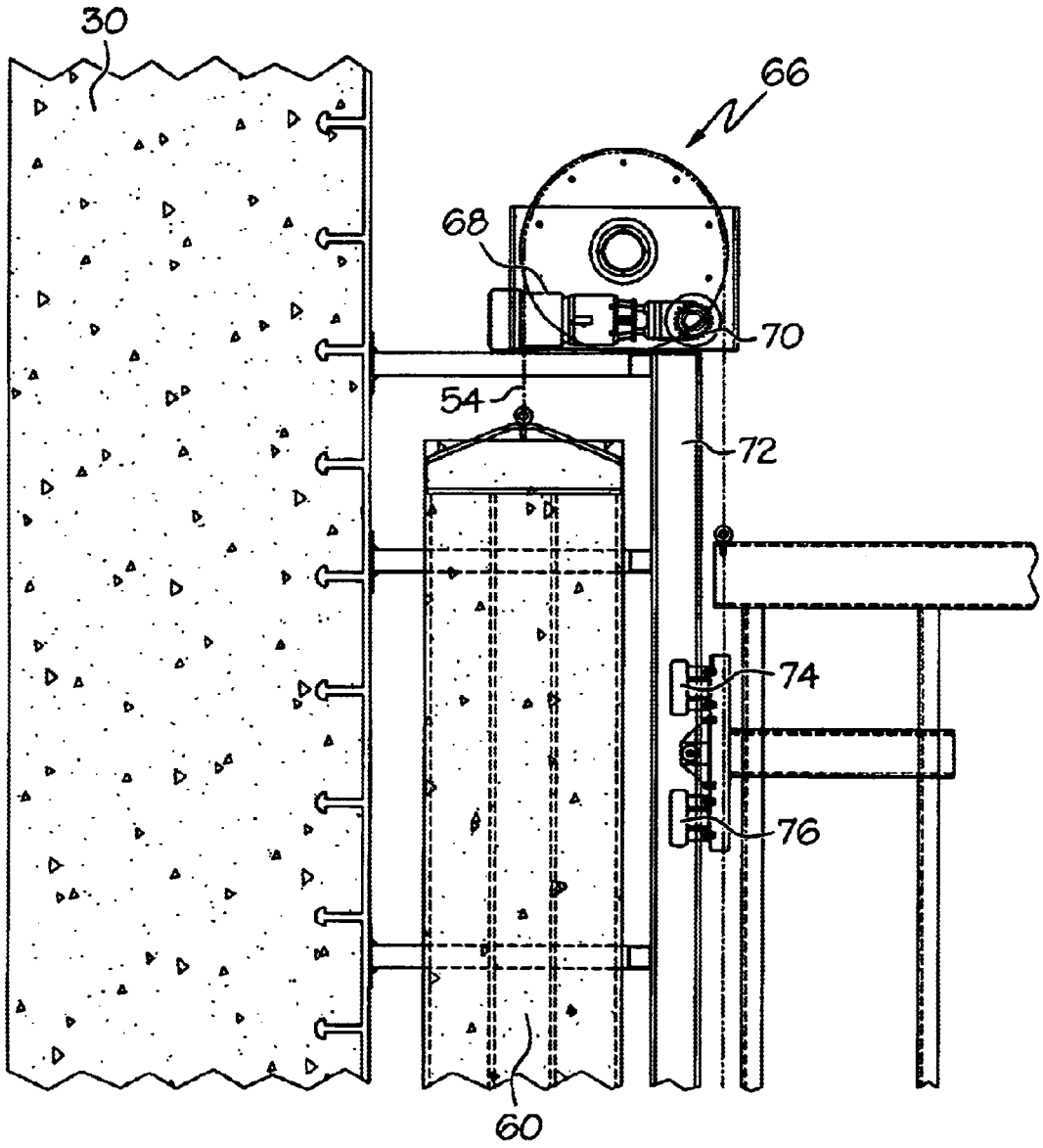
FIG. 5 is a fragmentary cross-sectional view depicting another portion of the mechanism shown in FIG. 4.
Figure 6:
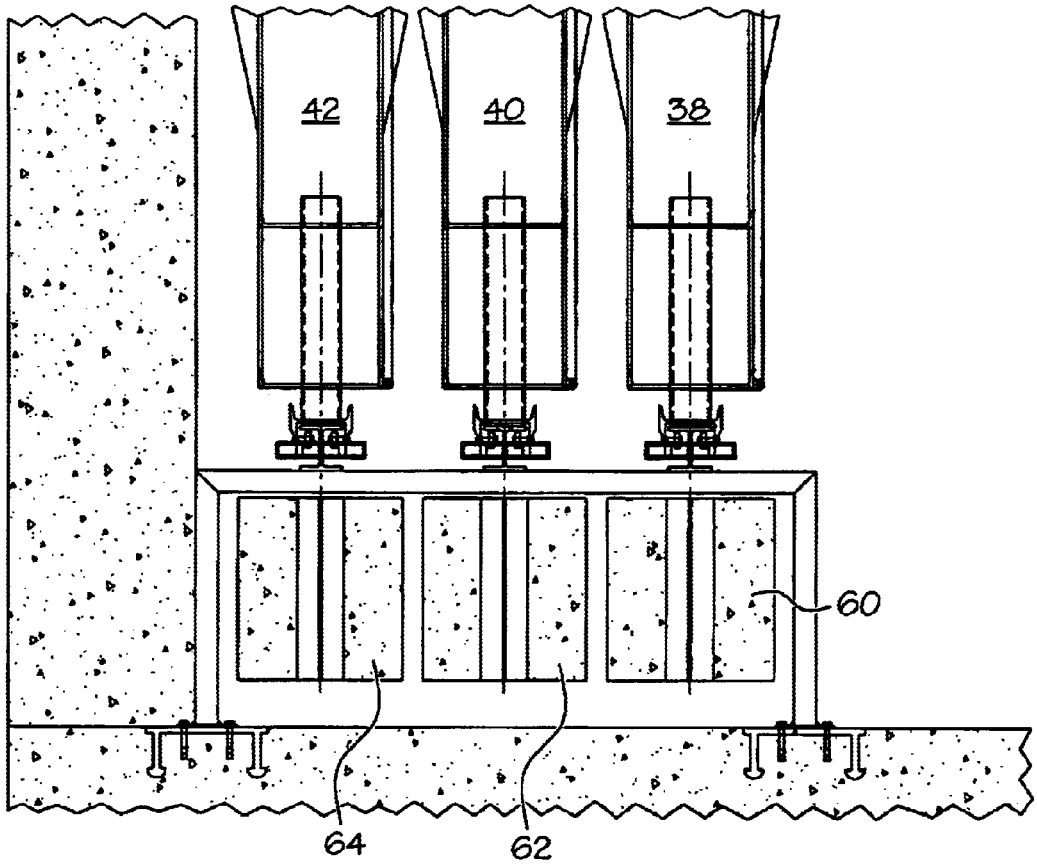
FIG. 6 is a fragmentary cross-sectional view depicting yet another portion of the mechanism shown in FIG. 4.

As may be seen in FIGS. 4–6, which depict operation of the transport mechanisms 28 that are provided on both sides of each of the movable wall panels 38, 40, 42, each upper horizontal portion 46 of the Z-shaped truss of each of the wall panels 38, 40, 42 is at both ends secured to and suspended from a cable 54, 56, 58, respectively. Each of the cables 54, 56, 58 are wrapped about a sheave and are secured at an opposite end to a counterweight 60, 62, 64, respectively. FIG. 5 depicts the sheave assembly 66 about which the first cable 54 extends. As may be seen in FIG. 5, sheave assembly 66 includes a variable electric motor 68 that is coupled to reduction gearing 70 for turning the sheave about which cable 54 is wound. In order to provide alignment and lateral stability for each of the movable wall panels 38, 40, 42, a vertical guide track 72 is provided immediately adjacent to each of the super columns 30, 32, and a plurality of rollers 74, 76 that are secured to the respective Z-shaped truss frame of the wall panel tightly engage the vertical guide track on both front and rear sides thereof.

Figure 7:
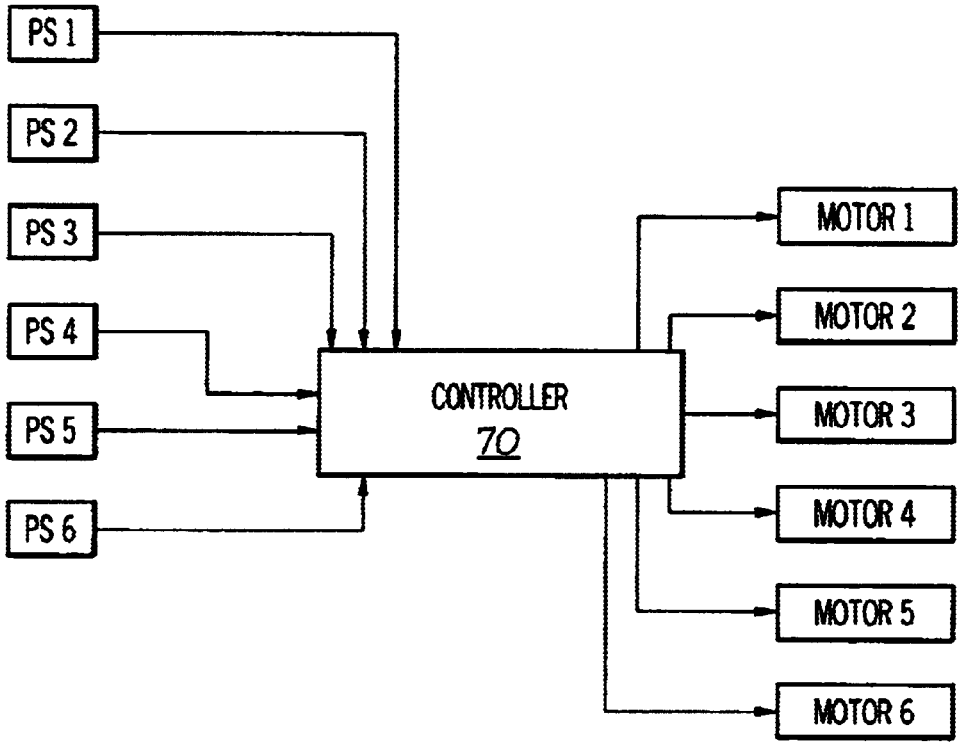
FIG. 7 is a schematic diagram depicting a control system for the movable wall assembly in the stadium complex that shown in FIGS. 1–6.

As may be seen in FIG. 7, which is a schematic depiction of the preferred control system for the movable wall member 26, a controller 70 which preferably is a programmable logic controller receives input from six different position sensors, each of which provides positional information relating to the vertical position of one side of one of the movable wall panels 38, 40, 42. In the preferred embodiment, position sensors PS1, PS2, PS3, PS4, PS5 and PS6 are preferably positioned in the sheave assembly and measure the position according to the displacement of the respective cable 54, 56, 58. Controller 70 further provides input to each of the six motors that control the sheave assemblies, each movable wall panel having two sheave assemblies dedicated thereto, one at each end.

The acceleration and deceleration of the electric motors is an important aspect of the invention. The conventional method of operating equipment is referred to as "across the line starting", whereby a magnetic contactor energizes the electric motors and the motors begin outputting full torque within 1 or 2 seconds. Traditionally, when the mechanism begins to move a conventional 3-phase motor will output 3 times its nameplate horsepower and torque. On start-up, when natural initial forces resist the acceleration of the mechanism, the traction wheel assembly will frequently slip slightly on the track as it tries to accelerate the mechanism. This slipping action will cause excessive wear, significant building vibration and general abuse of the collateral machinery. The same is true on a conventional mechanism when stopping. When the power is removed a fail-safe spring set brake is normally energized, which brings the mechanism to a rapid stop causing the traction wheel to slip and significant vibrations, wear & tear, and other objectionable phenomena to occur.

Figure 8:
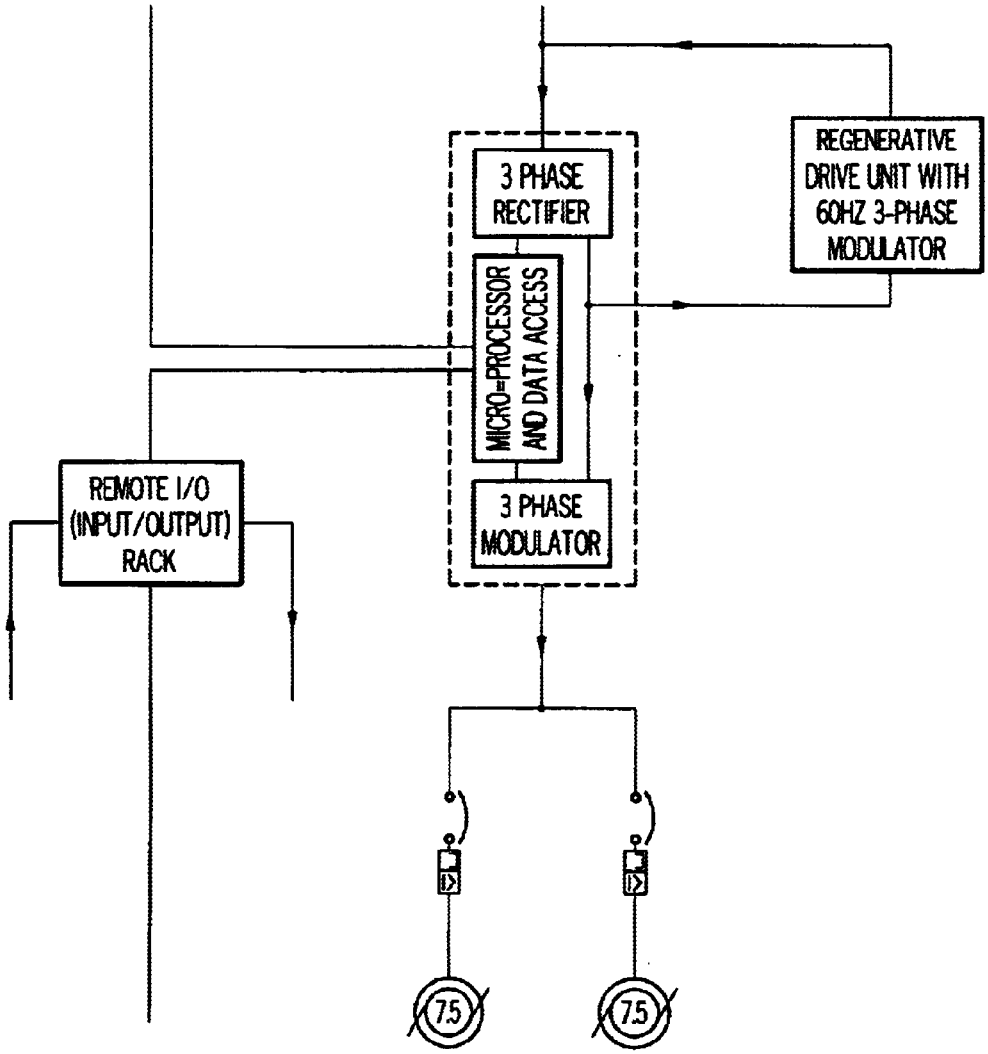
FIG. 8 is a schematic diagram depicting a motor control enclosure according to the preferred embodiment of the invention.

As may be seen in FIG. 8, the preferred embodiment of the invention utilizes a Variable Frequency Drive (VFD), which captures conventional AC current and converts it to DC current, then reconstructs the sine wave of the current back to a regulated AC sign form. This feature is very useful in the acceleration/deceleration phase. For example, on start-up the VFD will output current at approximately 5 to 10 Hertz rather than the conventional line current of 60 Hertz. Most all 3-phase AC motors are 4-pole motors. Preferably, conventional 3-phase 4-poles motors are used because they are extremely economical to purchase. A conventional 4-pole motor when powered with 60 Hertz current always turns at exactly 1750 RPM. The relationship of the 4-poles and the alternating current at 60 Hertz is fundamental, and the machine will always seek to run at 1750 RPM. With the application of the VFD the frequency can be reduced to as low as 5 Hertz, causing the motor to start at "creep" speed outputting a constant torque. At these low speeds it is required to inject a higher voltage to prevent rapid heat build-up, which is also a function of the micro-processor within the VFD. This micro-processor can be adjusted to output frequency on a sliding scale. Example: Over a period of 20 seconds the frequency will increase by 10 Hertz every 2 seconds. Thus, if the frequency begins at 10 Hertz, at the end of 10 seconds it will be at 100 Hertz causing the motor to run slightly faster than its normal RPM of 1750. This gives a gradual start, a gradual application of torque protecting the machinery, the building and all other mechanical equipment. The micro-processor is programmed based on a predetermined calculation regarding the maximum torque and inertia that collateral equipment can withstand. It is a function of the stiffness of the building structure, the weight of the retractable roof, and the stiffness of the collateral machinery. One important point is that the VFD is adjustable, and that by calculation is possible to arrive at the most favorable acceleration and/or deceleration curve.

The application of VFD's allows the equipment to be started at a very slow speed, and, in addition, to accelerate the equipment up to twice the normal speed of a standard 3-phase motor, thereby completing the cycle time at a much faster speed than a conventional arrangement. The VFD with the application of the Programmable Logic Controller (PLC) can also monitor the wind in and around the stadium. If it is found that the wind is of an excessive speed we can prevent the VFD from accelerating past a slower speed, thus protecting all of the machinery. This application of both the VFD and the PLC allows our mechanism to complete the opening cycle most of the time in half the speed of a conventional machine, while still maintaining the capability to slow down to ¼ the speed during high wind conditions to maintain safety. This arrangement is a significant improvement over conventional drives.

Another feature provided by the PLC, coupled to the VFD, is the ability for the operator to continuously monitor the motor voltage, the motor frequency, and the motor output torque. These figures are displayed on the operator's information screen and recorded continuously for historic reference and troubleshooting. These diagnostic features allow the operator confidence that the mechanism is functioning as intended and offer an early warning as soon as an inconsistency develops in the mechanism long before a serious failure would occur. The historical data logging is programmed to download through the internet on a high-speed communications link to a remote facility, thus enabling engineers to monitor all systems in the field to be sure they are working properly. This offers a much higher level of safety than was achievable in the past. The combination of these devices allows an unsophisticated owner with no engineering staff to operate highly technical equipment that heretofore could not be operated without a staff of engineers on-site, thereby significantly reducing the cost of ownership.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A convertible stadium, comprising:

an exhibition area;

a seating area that is constructed and arranged to permit spectators to view events in the exhibition area;

a substantially vertical sidewall that at least partially forms an outer periphery of said stadium, said sidewall having an opening defined therein that is at least 100 square meters in area;

a substantially vertical movable wall member, said movable wall member being movable between a first position wherein said movable wall member covers a first portion of said opening and a second position wherein said movable wall member covers less than said first portion of said opening, said movable wall member further comprising structural reinforcement against flexure during operation; and transport means for moving said movable wall member between said first position and said second position.

2. A convertible stadium according to claim 1, wherein said opening is at least 500 square meters in area.

3. A convertible stadium according to claim 1, wherein said opening is at least 1200 square meters in area.

4. A convertible stadium according to claim 1, wherein said opening is defined in a portion of said sidewall that is selected so that a person seated in at least one portion of said seating area will have a view of an outdoor landscape that is outside said stadium when said movable wall member is in said second position.

5. A convertible stadium according to claim 4, wherein said view of an outdoor landscape includes a view of the horizon.

6. A convertible stadium according to claim 1, wherein said movable wall member covers substantially said entire opening when in said first position.

7. A convertible stadium according to claim 1, wherein said movable wall member covers less than about 35 percent of said opening when in said second position.

8. A convertible stadium according to claim 1, wherein said movable wall member comprises more than one wall panel, said wall panels being movable relative to each other in order to reposition said movable wall member between said first and second positions.

9. A convertible stadium according to claim 8, wherein said wall panels are constructed and arranged to at least partially overlap each other when in said second position.

10. A convertible stadium according to claim 8, wherein said wall panels are mounted for vertical movement.

11. A method of operating a convertible stadium that includes an exhibition area, a seating area and a substantially vertical sidewall having a large opening to the outdoors defined therein, comprising steps of:

(a) positioning a substantially vertical movable wall having structural reinforcement against flexure during operation in a first, closed position so as to cover at least a first portion of the opening; and (b) moving the movable wall to a second, open position wherein the movable wall member covers less than the first portion of said opening, whereby the exhibition and seating areas will be exposed to an outdoor enhanced environment.

12. A method according to claim 11, wherein step (a) is performed so that said movable wall member covers substantially said entire opening when in said first position.

13. A method according to claim 11, wherein step (b) is performed so said movable wall member covers less than about 35 percent of said opening when in said second position.

14. A method according to claim 11, wherein step (b) is performed so that spectators in at least one portion of the seating area will be provided with a view of the horizon through said opening.

15. A method according to claim 11, wherein step (b) is performed so that spectators in at least one portion of the seating area will be provided with a view of an outdoor landscape through said opening.

16. A method of operating a convertible stadium that includes an exhibition area, a seating area and a substantially vertical sidewall having a large opening to the outdoors defined therein, comprising steps of:

(a) positioning a substantially vertical movable wall having structural reinforcement against flexure during operation in an open position so as to leave a first substantial portion of the opening unobstructed, providing openness between the exhibition area, the seating area and the outdoor environment; and (b) moving the movable wall to a second, closed position wherein less than the first, substantial portion of the opening is left unobstructed, thereby reducing the amount of openness between the exhibition area, the seating area and the outdoor environment.

17. A method according to claim 16, wherein step (b) is performed so as to obstruct an amount of direct sunlight from falling on at least one of the exhibition area and the seating area.

18. A method according to claim 16, wherein step (b) is performed so as to obstruct entrance of undesirable outdoor elements into the interior of the stadium.

19. A method according to claim 18, wherein the undesirable outdoor element includes wind.

20. A method according to claim 18, wherein the undesirable outdoor element includes temperature.

21. A convertible stadium, comprising:

an exhibition area;

a seating area that is constructed and arranged to permit spectators to view events in the exhibition area;

a substantially vertical sidewall that at least partially forms an outer periphery of said stadium, said sidewall having an opening defined therein that is at least 100 square meters in area;

a substantially vertical movable wall member having structural reinforcement against flexure during operation, said movable wall member comprising a plurality of movable wall panels, said wall panels being mounted for independent movement with respect to the other wall panels and being shaped and sized so as to permit substantial overlap therebetween, whereby said wall panels are able to be extended and contracted with respect to each other to respectively cover and uncover said opening;

transport means for moving said movable wall panels; and a control system for operating said transport means.

22. A convertible stadium according to claim 21, wherein each of said movable wall panels comprises a structural reinforcing truss that is Z-shaped in cross-section, whereby each of the movable wall panels is given strength against flexure and is shaped so as to permit nesting with other of said movable wall panels.

23. A convertible stadium according to claim 21, wherein said transport means comprises a mechanism for vertically moving said movable wall panels.

24. A method of operating a convertible stadium that includes an exhibition area, a seating area, a roof and a sidewall having a large opening to the outdoors defined therein, comprising steps of:

(a) positioning a substantially vertical movable wall having structural reinforcement against flexure during operation in a first, closed position so as to cover at least a first portion of the opening; and (b) moving the movable wall to a second, open position wherein the movable wall member covers less than the first portion of said opening, whereby the exhibition and seating areas will be exposed to an outdoor enhanced environment.

25. A method of operating a convertible stadium that includes an exhibition area, a seating area, a roof and a sidewall having a large opening to the outdoors defined therein, comprising steps of:

(a) positioning a substantially vertical movable wall having structural reinforcement against flexure during operation in an open position so as to leave a first substantial portion of the opening unobstructed, providing openness between the exhibition area, the seating area and the outdoor environment; and (b) moving the movable wall to a second, closed position wherein less than the first, substantial portion of the opening is left unobstructed, thereby reducing the amount of openness between the exhibition area, the seating area and the outdoor environment.

26. A convertible stadium, comprising:

an exhibition area;

a seating area that is constructed and arranged to permit spectators to view events in the exhibition area;

a sidewall that at least partially forms an outer periphery of said stadium, said sidewall having an opening defined therein that is at least 100 square meters in area;

a roof positioned above said sidewall;

a substantially vertical movable wall member, said movable wall member comprising a plurality of movable wall panels, each of said wall panels having structural reinforcement against flexure during operation and being mounted for independent movement with respect to the other wall panels and being shaped and sized so as to permit substantial overlap therebetween, whereby said wall panels are able to be extended and contracted with respect to each other to respectively cover and uncover said opening;

transport means for moving said movable wall panels; and a control system for operating said transport means.

27. A convertible stadium according to claim 26, wherein each of said movable wall panels comprises a structural reinforcing truss that is Z-shaped in cross-section, whereby each of the movable wall panels is given strength against flexure and is shaped so as to permit nesting with other of said movable wall panels.

* * * * *